United States Patent [19]

Long

[11] 4,126,179

[45] Nov. 21, 1978

[54] LOCATING SYSTEM

[75] Inventor: Olen R. Long, Celina, Tex.

[73] Assignee: Otis Engineering Corporation, Dallas, Tex.

[21] Appl. No.: 805,294

[22] Filed: Jun. 10, 1977

[51] Int. Cl.[2] ..... E21B 33/129

[52] U.S. Cl. ..... 166/64; 166/156; 166/214

[58] Field of Search ..... 166/214, 154, 156, 332, 166/64

[56] References Cited

U.S. PATENT DOCUMENTS

| | | | |
|---|---|---|---|
| 2,673,614 | 3/1954 | Miller | 166/214 |
| 2,862,564 | 12/1958 | Bostock | 166/214 |
| 3,335,802 | 8/1967 | Seyffert | 166/214 |
| 3,845,815 | 11/1974 | Garwood | 166/154 |

*Primary Examiner*—Ernest R. Purser
*Attorney, Agent, or Firm*—Vinson & Elkins

[57] ABSTRACT

Disclosed is a system for locating well equipment at preselected locations within a well's tubing string. Positioned within the tubing string are a plurality of series of locating nipples. A locating tool runs through the tubing string. The locating tool may pass through at least one entire series of locating nipples without engaging any one nipple and subsequently engage a selected locating nipple in another series of locating nipples. This abstract is neither intended to define the scope of the invention, which, of course, is measured by the claims, nor is it intended to be limiting in any way.

17 Claims, 9 Drawing Figures

LOCATING SYSTEM

BACKGROUND OF THE INVENTION

1. Field of the Invention

This invention relates to the system for locating well equipment within the tubing string of a well. Within the tubing string are positioned locating nipples, each of which has an internal recess of a selected configuration. A tool, having expandable keys, is run through the tubing string. The keys have an outer configuration designed to mate with the internal recess configuration of a selected locating nipple.

2. The Prior Art

Frequently wells are designed so that one operation may be performed in any one of several locations therein. For example, a plurality of identical sliding sleeve valves may be positioned in the well. Frequently, it is desired to shift the sleeve of one such valve while not disturbing the sleeves of the other valves. To lessen the likelihood that the desired operation will be performed at the wrong location, selective locating systems for wells have been devised.

Heretofore, selective locating systems have generally included a single series of locating nipples. Each nipple in the series has an internal recess of a different configuration. A locating tool, having locator keys, would be run through the tubing string. The locator keys have an outer configuration which mates with the internal recess of a selected one of the locating nipples. Such locating systems are disclosed in U.S. Pat. No. 2,673,614 and 2,862, 564.

Deep wells require more locating positions than shallower wells. Well depth has graudally been increasing. Consequently, the number of desired locating positions within a well has also been increasing.

Additionally, more and more wells ae being equipped for use with pump down equipment. A pump down tool train must pass through a loop or curved portion of tubing prior to entry into the well. Therefore, each tool section is short. The short length required for pump down tools has limited the number of possible configurations for a locator key.

Presently, approximately 20 select positions can be arranged in a well. A single series of 20 locating nipples, each having an internal recess with a different configuration, can be positioned in the well. A locating tool is provided with 20 sets of keys. One specific set of locator keys will mate with the internal recess of a selected landing nipple. However, for some deep wells, 20 select positions is insufficient. More select locating positions are desired. Until this invention, an increased number of locating positions could not be obtained.

OBJECTS OF THE INVENTION

An object of this invention is to provide an increased number of obtainable locating positions within a well.

Another object of this invention is to permit a plurality of identical series of locating nipples to be positioned within a well tubing string and thereby increase the number of select locating positions in the well.

Another object of this invention is to provide a locating tool that can pass through at least one series of locating nipples and subsequently engage a select locating nipple upon passage through another series of locating nipples.

These and other objects and features of advantage of this invention will be apparent from the drawings, detailed description, and the appended claims.

BRIEF DESCRIPTION OF THE DRAWINGS

In the figures, wherein like numerals indicate like parts, and wherein an illustrative embodiment of this invention is shown.

DETAILED DESCRIPTION OF THE PREFERRED EMBODIMENT

Many different well operations will be performed in the tubing string 10 of a well. Certain operations must be performed at a specific location within the tubing string 10. To positively locate a tool train as it is being run through the tubing string 10, a series of locating nipples **12*a*, 12*b*, 12*c* and 12*d* may be positioned within the tubing string 10 at known, spaced locations. Each locating nipple has an internal recess 14*a*, 14*b*, 14*c* and 14*d***, respectively, of a different configuration.

The tool train is made up to include a locating tool. The locating tool engages the internal recess 14 of a selected locating nipple 12. The tool train is thereby positively located in the tubing string 10.

Figure 1A:
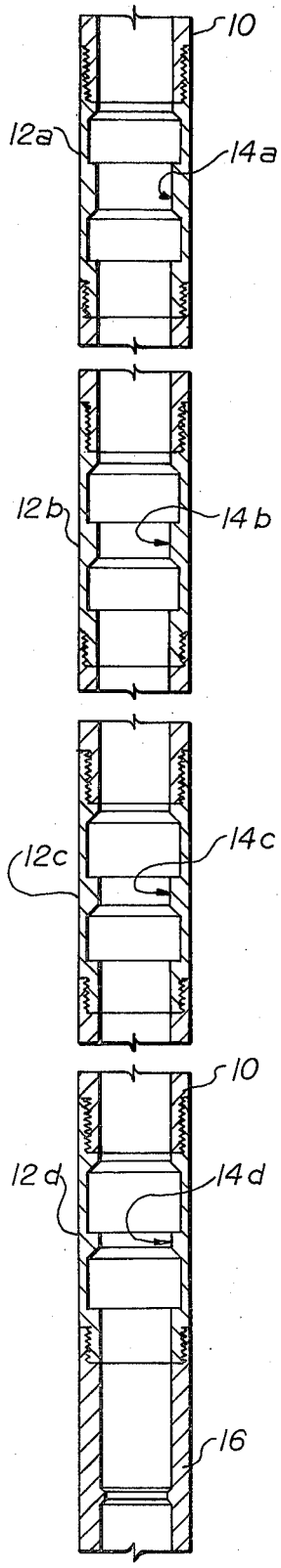
FIGS. 1A, 1B, and 1C are continuation views, in section, of a well tubing string having a plurality of series of locating nipples positioned therein.
Figure 1B:
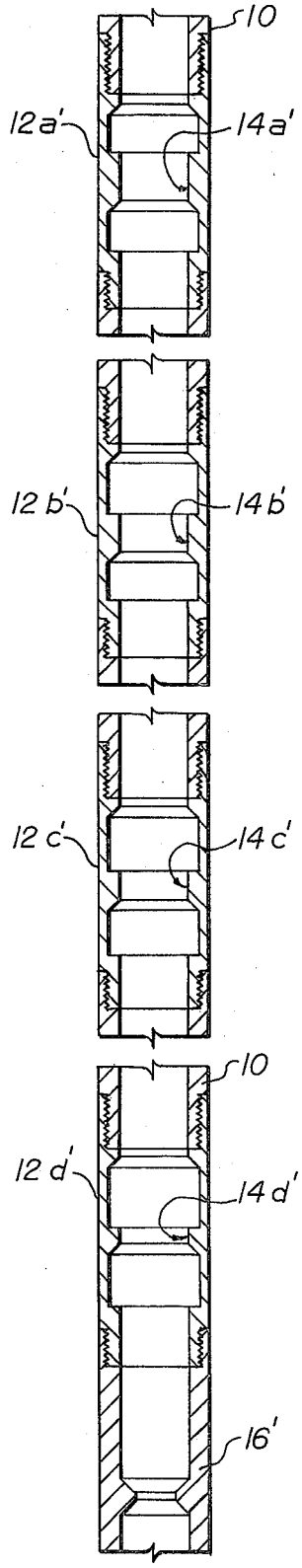
Figure 1C:
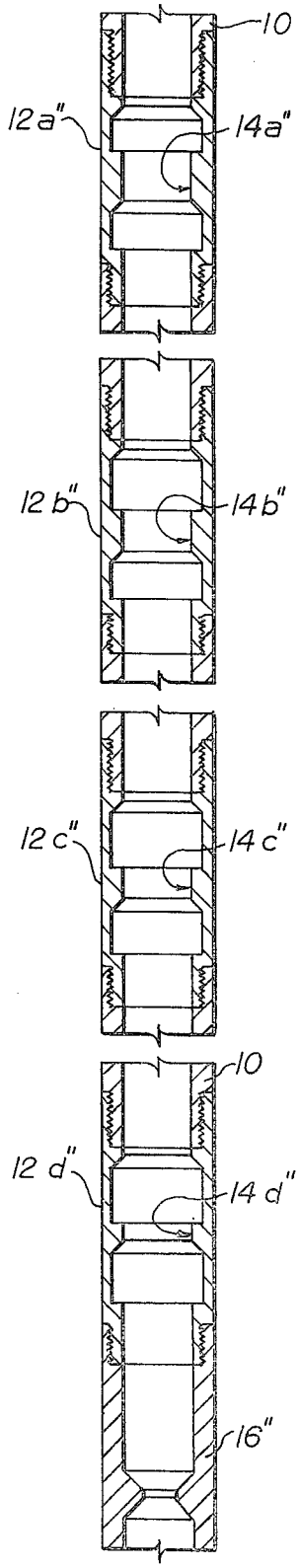

In accordance with this invention, multiple series of locating nipples 12 may be positioned within the tubing string 10. Each series of locating nipples 12 may be identical. The different series would be spaced vertically in the tubing string 10. The number of positive, known locations in the tubing string 10 is thereby increased. The number of locations now equals the number of nipples in each series times the number of series utilized. In FIGS. 1A, 1B and 1C, three identical series **12*a* through 12*d*, 12*a*′ through 12*d*′ and 12*a*″ through 12*d*″ of locating nipples are illustrated positioned within the tubing string 10**. Additional or fewer or series of locating nipples could be so positioned depending upon the well installation.

In accordance with this invention, a locating tool of a tool train may pass through at least one series of locating nipples 12. Thereafter, the locating tool will be rendered effective to engage a selective locating nipple within another series of locating nipples. To selectively render the locating tool effective so that it may engage a select locating nipple within a select series of locating nipples, means 16, 16′ and 16″ for selectively activating the locating tool are provided between each series of locating nipples 12, 12′ and 12″. These selective activating means 16, 16′ and 16″ may comprise the graduated restrictions illustrated.

Figure 2:
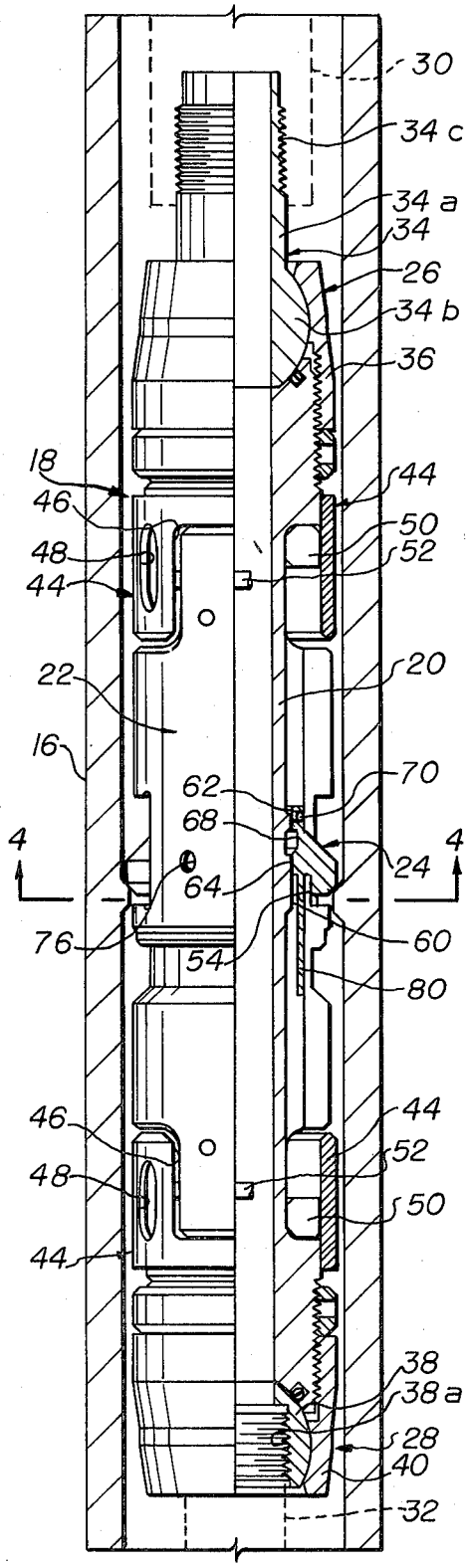
FIG. 2 is a quarter-sectional view of a locating tool after having been run through at least one series of locating nipples and prior to being run through the series of locating nipples in which it will engage one selected nipple.

The locating tool 18 is shown engaging the graduated restriction 16 in FIG. 2. The locating tool 18 comprises a tool mandrel 20, locator key means 22, and actuator means 24. Locator key means 22 will engage the internal recess 14 of a select locating nipple 12. Actuator means 24 prevents the locator key means 22 from engaging any of the recesses 14 as the locating tool 18 passes through at least one series of locating nipples 12. Thereafter, actuator means 24 coacts with one of the selective activating means 16 and actuates the locator key means 24. Upon passage of the locating tool 18 through the next series of locating nipples 12, the locator key means 22 will engage the internal recess 14 of a select locating nipple 12.

The tool mandrel 20 comprises one short section of a pump down tool train. Tool mandrel 20 carries locator key means 22 and other components of the locating tool 18. As shown, connector means 26 and 28 may be provided at each end of the tool mandrel 20 for connecting the locating tool 18 to other tools 30 and 32 (indicated in dotted form) of the pump down tool train. The connector means 26 and 28 may be the ball and socket connections shown.

Connector means 26 comprises ball member 34 having an upwardly extending stem portion **34*a* and a ball portion 34*b*. Surrounding the ball portion 34*b* is a socket 36 which is threaded to the tool mandrel 20. The upwardly extending stem portion 34*a* includes outer threads 34*c* for connection to another tool 30 (shown in dotted form) of the tool train. The lower connecting means 28 may comprise a ball 38 received within a socket 40. The socket 40 is connected to the tool housing 20. The ball 38 includes inner threads 38*a* to which are threaded an upwardly facing stem of another tool 32** of the tool train.

Locator key means 22 are carried by the tool mandrel 20. The locator key means 22 have an outer configuration which is adapted to mate with the internal recess of a selected one locating nipple within one series of locating nipples. Therefore, in accordance with this invention, the outer configuration of the locator key means 22 may mate with the inner recess of a plurality of locating nipples in the well tubing string 10. Each of these locating nipples 12 with which the locator key means 22 could mate, would be positioned within a different series of locating nipples 12.

Figure 3:
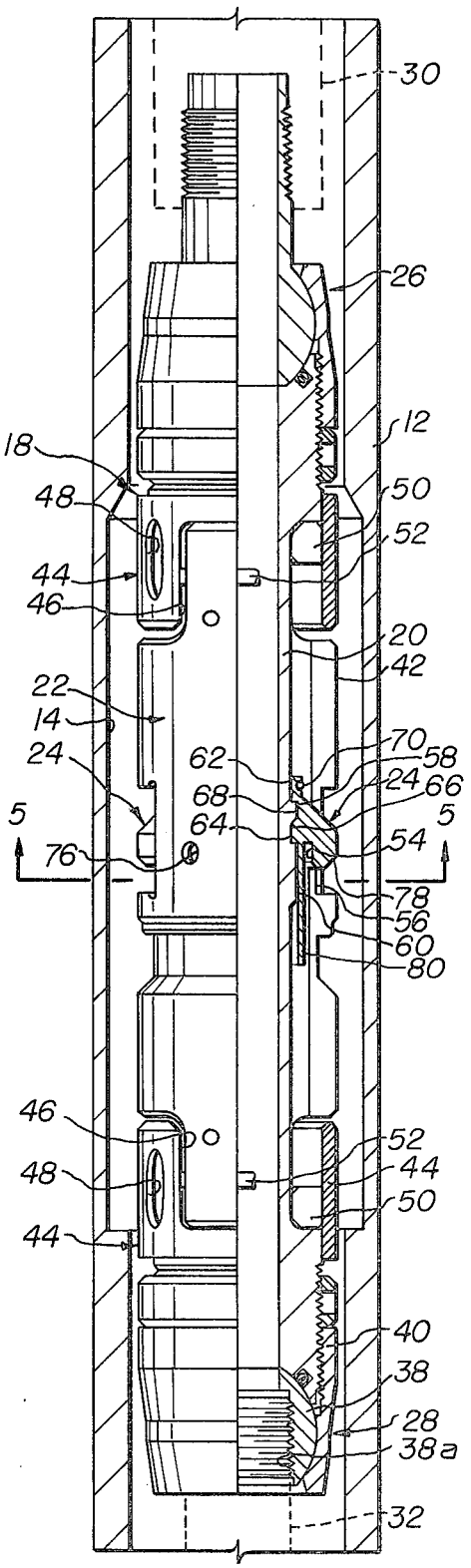
FIG. 3 is a quarter-sectional view showing the locating tool of FIG. 2 engaging a locating nipple.
Figure 6:
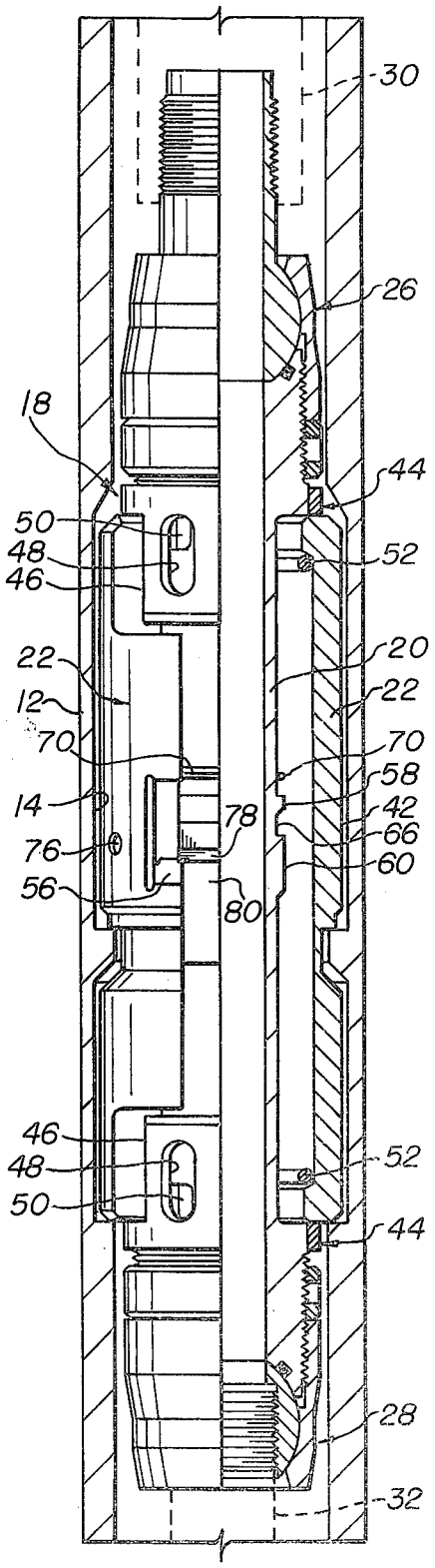
FIG. 6 is a quarter-sectional view taken at right angles to the view in FIG. 3.

Locator key means are adapted to move radially with respect to the tool mandrel 20. During running of the locating tool 18 through the tubing string 10, the locator key means 22 will assume three different positions. First, locator key means 22 will be held in a radially, retracted position on the tool mandrel 20 (see FIG. 2). In that radially, retracted position, locator key means 22 can not engage the recess 14 of any locating nipple 12 through which the locator tool 18 passes. Instead, all of the locating nipples 12 will be by-passed. In a second operative position, locator key means 22 is urged radially outwardly. Radial outward movement of locator key means 22 is limited by the engagement of the outer surface 42 of locator key means with the internal wall of the tubing string 10. As the locating tool 18 moves through the tubing string 10, locator key means 22 will by-pass those landing nipples 12 which have an internal recess 14 which does not mate with the external configuration of locator key means 22. However, when the locating tool 18 reaches the selected landing nipple 12, locator key means 22 will assume their third position. In their third position, locator key means 22 are expanded radially to their outermost position (see FIGS. 3 and 6). Their outer portion is received within the recess 14 of the selected landing nipple 12. Further movement of the locating tool 18 and tool train through the tubing string 10 is stopped.

Mounting means, such as collars 44, mount the locator key means 22 on the tool mandrel 20. Mounting collar means 44 permit the outwardly radial movement of locator key means 22 with respect to the tool mandrel 20. If desired, the mounting collar means 44 may also restrict the axial movement of locator key means 22 with respect to the tool mandrel 20.

For the locating tool 18 shown, two mounting means 44 are positioned on the tool mandrel 20. The two mounting collar means 44 each confine a different end of the locator key means 22. Each mounting collar means 44 includes two opposed cut-outs 46 and four slots 48. The cut-outs 46 receive the extreme longitudinal ends of the locator key means 22. The slots 48 receive a projecting ear 50 of the locator key means 22. The engagement of the ear 50 within the slots 48 permits the radial movement of the locator key means 22 with respect to the tool mandrel 20.

Inherently resilient biasing means, such as spring 52, bias locator key means 22 radially outwardly with respect to the tool mandrel 20. However, in accordance with this invention, during movement of the tool train through a portion of the tubing string 10, the spring means 52 will be rendered ineffective. They will be unable to move locator key means 22 radially outward. However, after operation of the actuator means 24, spring means 52 will be rendered effective. Thereafter, locator key means 22 will be movable radially outwardly and will be permitted to engage that select locating nipple 12 which has an internal recess 14 which matches the outer configuration of locator key means 22.

Actuator means 24 selectively renders spring means 52 ineffective and effective. While in a first, expanded position with respect to the tool mandrel 20, actuator means 24 confines locator key means 22 in their first radially retracted position (See FIG. 2). Spring means 52 can not move the locator key means 22 radially outwardly. While in a second, contracted position with respect to the tool mandrel 20, actuator means 24 permits radially outward movement of locator key means 22 (See FIG. 3). Spring means 52 is rendered effective to move the locator key means 22 radially outwardly.

For confining key means 22 radially inwardly, actuator means 24 includes an inwardly facing lip portion 54. Lip 54 is designed to engage an outwardly facing shoulder 56 of locator key means 22. When the lip portion 54 and the shoulder 56 have engaged, and the actuator means 24 are in their first position (See FIG. 2), the locator key means 22 are radially retracted. When the lip portion 54 is disengaged from the shoulder 56 (See FIG. 3), the locator key means 22 are permitted to expand radially outwardly.

The actuator means 24 moves between its first, expanded and second contracted positions with respect to the tool mandrel 20 upon engagement with a selective one of the tubing string activating means 16. The engagement of the tool actuator means 24 with the activating means 16 in the well, permits a downward movement of the tool mandrel 20 with respect to the tool actuator means 24. Once the tool mandrel 20 moves downwardly a short, but sufficient distance, tool actuator means 24 disengages from the locator key means 22, moves to its second contracted position, and disengages from the well's selective actuating means 16. While in their first, expanded position, actuator means 24 have their largest effective distance between their outermost extremities. In their second, collapsed position, actuator means 24 have their smallest effective distance between their outermost extremities.

Coacting surfaces on the tool mandrel 20 and on actuator means 24 selectively co-engages to either maintain actuator means 24 in its first expanded position or permit contraction of actuator means 24 to its second contracted position. For engaging and maintaining actuator means 24 in its first, expanded position, the tool mandrel 20 includes outer cylindrical surfaces 58 and 60 (best seen in FIG. 6). The inwardly facing surfaces 62 and 64 of actuator means 24 engage the mandrel's cylindrical surfaces 58 and 60 when actuator means 24 is in its first expanded position. Between the mandrel's cylindrical surfaces 58 and 60, is a recess 66. Likewise, between the inwardly facing surfaces 62 and 64 of actuator means 24 is a recess 68. The recess 68 is designed to receive the inwardly facing surface 64 of actuator means 24 when actuator means 24 is in its second position. Likewise, the recess 68 is designed to receive the outwardly facing cylindrical surface 58 of the tool mandrel 20 when the actuator means 24 is in its second position. Therefore, when actuator means 24 are in their first position, movement of the tool mandrel 20 downwardly with respect to actuator means 24 permits actuator means 24 to collapse inwardly to their second contracted position. The longitudinal length of the surfaces 58 and 64 and the longitudinal length of the recesses 66 and 68 permits movement of the actuator means 24 from its first position to its second position upon minimal longitudinal movement of the tool mandrel 20.

To collapse actuator means 24 inwardly, yieldable resilient urging means 70, such as snap ring 70, resiliently urges actuator means 24 radially inwardly.

Figure 4:
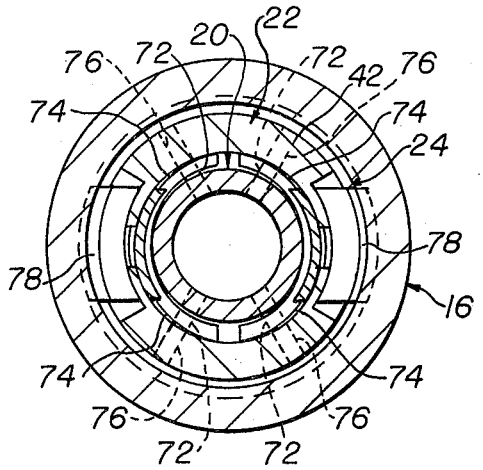
FIG. 4 is a cross-sectional view taken along line 4—4 of FIG. 2.
Figure 7:
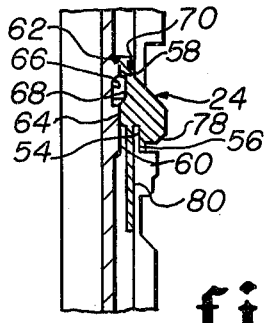
FIG. 7 is an enlarged partial sectional view taken along line 7—7 of FIG. 2.
Figure 5:
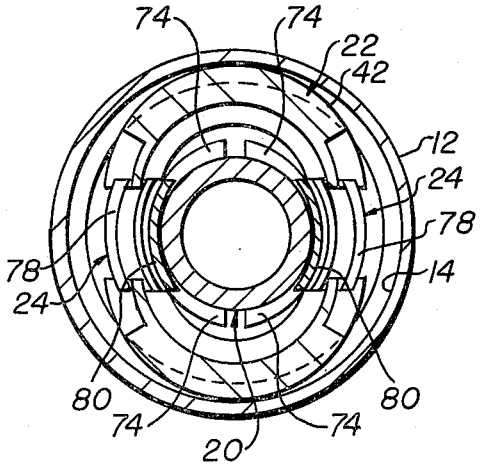
FIG. 5 is a cross-sectional view taken along line 5—5 of FIG. 3.

Actuator means 24 are releasably maintained in their first, expanded position on the tool mandrel 20. Releasable holding means 72, such as shear screws 72 (shown in dotted form on FIG. 4) releasably maintain actuator means in their first position. As illustrated, the releasable holding means 72 may extend through a curved wing portion 74 of actuator means 24 and the wall of the tool mandrel 20. The locator key means 22 have holes 76 positioned so that the shear screws 72 may be threaded into the curved actuator wing portion 74 and the tool mandrel 20.

Tool actuator means 24 includes downwardly facing chamferred stop shoulder means 78 sized to engage one of the well's selective activating means 16. The tool actuator means 24 may pass through one or more well activating means 16 and engage another selective activating means 16 deeper in the well. Thereafter, the tool actuator means 24 would actuate the locating tool 18 and permit the locator key means to engage the next locating nipple 12 having an internal recess 14 which matches the key's outer configuration. One manner of designing the tool actuator means 24 and the well activating means 16 for this selective co-engagement and activation is to vary the inside diameters of the well activating means 16 and the outside diameters of the tool actuator means 24. For example, at increasing well depths, the well activating means 16 could have increasingly smaller inside diameters. Thus, in the Figures, the well activating means 16 has a first inside diameter, the well activating means 16' has a second inside diameter which is smaller than the first inside diameter, and the well activating means 16'' has a third inside diameter which is smaller than the second inside diameter. The actuator means 24, when actuator means 24 is in its first position, would then be designed to engage a specific one of the well activating means 16. For example, if it was desired to engage the second well activating means 16', the downwardly facing stop means 78 would be sized to pass through the first activating means 16 and engage the second activating means 16'. In other words, the outermost extremity of actuator means 24, when in its first position, would be less than the distance across inside diameter of the first well activating means 16 but greater than the distance across inside diameter of the second well activating means 16.

During the running of the locating tool 18 through the tubing string 10 prior to engagement with the well activating means 10, the tool actuator means 24 will most likely engage and pass through numerous obstructions. To prevent the tool actuator means 24 from inadvertently shifting due to its engagement with an obstruction, the tool actuator means 24 includes a downwardly depending leg means 80. The leg means 80 are designed to engage the inner wall of locator key means 22 when actuator means 24 are in their first position. They thereby prevent actuator means 24 from becoming misaligned. Any such misalignment could vary the distance across the radial most extremity of actuator means 24. If that distance was appreciably varied, the tool actuator means 24 could engage the wrong well activating means 16. Until actuation, it is desired that actuator means 24 be maintained properly aligned in its first, expanded position on the tool mandrel 20. Therefore, only when the opposed tool actuator means 24 both engage the properly sized selective well actuating means 16, is the tool actuator means 24 moved to its second position.

In operation, the locating system of this invention permits a tool train to be positively located at a subsurface location in a well tubing.

The well tubing string 10 would be made up to include a plurality of locating nipples **12*a*, 12*b*, 12*c* and 12*d*. In addition to the one series of locating nipples 12*a* through 12*d*, the tubing string would also include additional series 12' through 12*d'* and 12*a''* through 12*d''* of locating nipples. Between each series of locating nipples would be located tubing selective actuating means 16, 16' and 16''**.

The tool train would be made up to include a locating tool 18. The locating tool 18 would be arranged so that the tool actuator means 24 are in their first expanded position and confine the locator key means 22 radially inwardly in their first retracted position. The tool train would be run through the tubing string 10.

As long as the locator key means 22 are confined inwardly by the tool actuator means 24, the locating tool 18 by-passes locating nipples in the well tubing string 10. Depending upon the effective distance between the outermost extremities of actuator means 24, one or more series of locating nipples 12 may be bypassed in this manner. All during this downward movement of the tool train, the spring means 52 has been rendered ineffective. The locator key means 22 are held confined inwardly by the lip portion 54 of the actuator means 24 against the outwardly applied force of spring means 52.

The actuator means 24 will engage one of the selective activating means 16 in the tubing string 10. Such engagement is illustrated in FIG. 2. A downward force is applied to the tool train until shear screws 72 shear. Continued downward movement of the tool train will move the tool mandrel 20 downwardly a short distance with respect to the tool actuator means 24. The actuator's inwardly facing surface 64 will become disposed opposite the mandrel's recess 66 and the mandrel's outer surface 58 will become disposed opposite the actuator's inner recess 68. Actuator means 24 is collapsed inwardly to its second position by the yieldable urging means 70. The distance between the outermost extremities of actuator means 24 is now less than the inside diameter of the selective actuating means 16. The locating tool 18 may pass through the activating means 16. The lip portion 54 of actuator means 24 has disengaged from the recess 56 of locator key means 22. Spring means 52 is rendered effective. The locator key means 22 expand radially outwardly.

Downward movement through the tubing string of the tool train is continued. As the tool train passes through a locating nipple 12, the locator key means 22 would be urged outwardly into the recess 14. However, unless the internal configuration of the recess 14 matches the outer configuration of the locator key means 22, the locator key means 22 will not engage the recess 14. Therefore, the locating tool 18 and the tool train will pass through that locating nipple 12. The locating tool 18 will pass through all locating nipples in a series of locating nipples 16 until the select locating nipple is reached. When the select locating nipple 12 is reached, the locator key means 22 expand radially outwardly into the mating recess 14 (see FIGS. 3 and 6). Engagement of the locator key means 22 with the locating nipple 12 positively locates the tool train in the tubing string 10. Thereafter, any desired well operation may be performed.

From the foregoing, it can be seen that the objects of this invention have been obtained. An increased number of positive locations within a well can now be selected. A plurality of series of locating nipples can be positioned within the well tubing string. Each locating nipple within the series can have an internal recess of a different configuration to provide one source of selectively locating positions within the well. Between each series of locating nipples is an activator. The well activator provides a second source of selective locating by permitting selection of that series of locating nipples in which a locating tool will be effective. The locating tool will include locator keys which can engage a locating nipple in each series of locating nipples. The locating tool will also include an actuator which permits selective actuation of the locator keys within one series of locating nipples. The multiplied number of positive locations thereby obtained permits the precise location of a tool train at the numerous points required for many different well operations.

The foregoing disclosure and description of the invention are illustrative and explanatory thereof. Various changes in the size, shape, and materials, as well as the details of the illustrated construction, may be made within the scope of the appended claims without departing from the spirit of the invention.

What is claimed is:

1. A locating device for locating one and only one of a plurality of identical locating nipples in a well tubing string and thereby locating a well tool in the tubing string, the locating device comprising:

a tool mandrel;

locator key means having an outer configuration adapted to mate with a matching recess of a plurality of locating nipples in the tubing string and once so mated halting further movement of the locating device in one direction through the tubing string;

means for mounting said locator key means on said tool mandrel and for permitting radial movement of said locator key means with respect to said tool mandrel;

means for resiliently biasing said locator key means radially outwardly;

actuator means carried on said tool mandrel for rendering said means for resiliently biasing ineffective until engagement with a coacting selective activating means in the tubing string; and wherein while said resilient biasing means is rendered ineffective, said locator key means may pass through any of said locating nipples without engagement therewith and once said resilient biasing means is rendered effective said locator key means mates with the next locating nipple having a matching recess upon continued movement of the locating device in said one direction.

2. A locating device of claim 1 wherein:

said actuator means is movable between a first position engaging said locator key means and preventing outward radial movement thereof and a second position disengaged from said locator key means and permitting outward radial movement thereof.

3. The locating device of claim 2 wherein said tool mandrel moves axially with respect to said actuator means to enable movement of said actuator means between said first and said second position.

4. The locating device of claim 2 wherein said actuator means includes an outer stop surface for engaging the coacting selective activating means.

5. The locating device of claim 2 additionally including:

releasable holding means for releasably holding said actuator means in said first position.

6. A locating device for locating one of a plurality of identical locating nipples in a well tubing string and thereby locating a well tool in the tubing string, the locating device comprising:

a tool mandrel;

locator key means having an outer configuration adapted to mate with a recess of a plurality of locating nipples in the tubing string;

means for mounting said locator key means on said tool mandrel and for permitting radial movement of said locator key means with respect to said tool mandrel;

means for resiliently biasing said locator key means radially outwardly;

actuator means carried on said tool mandrel for rendering said means for resiliently biasing ineffective until engagement with a coacting selective activating means in the tubing string;

said actuator means being movable between a first position engaging said locator key means and preventing outward radial movement thereof and a second position disengaging from said locator key means and permitting outward radial movement thereof; and said mandrel having a recess adapted to receive a portion of said actuator means after said actuator means have moved to their second position for permitting said actuator means to collapse radially.

7. The locating device of claim 4 additionally including:

resilient urging means for collapsing said actuator means to its second position.

8. A locating device for locating one of a plurality of identical locating nipples in a well tubing string and thereby locating a well tool in the tubing string, the locating device comprising:

a tool mandrel;

locator key means having an outer configuration adapted to mate with a recess of a plurality of locating nipples in the tubing string;

means for mounting said locator key means on said tool mandrel and for permitting radial movement of said locator key means with respect to said tool mandrel;

means for resiliently biasing said locator key means radially outwardly;

actuator means carried on said tool mandrel for rendering said means for resiliently biasing ineffective until engagement with a coacting selective activating means in the tubing string;

said actuator means being movable between a first position engaging said locator key means and preventing outward radial movement thereof and a second position disengaging from said locator key means and permitting outward radial movement thereof; and wherein said actuator means includes alignment leg means for maintaining said actuator means properly aligned in their first position so that they engage the selective activating means in the tubing string and by-pass other restrictions in the tubing string.

9. A locating device for locating one and only one of a plurality of identical locating nipples in a well tubing string and thereby locating a well tool in the tubing string, the locating device comprising:

a tool mandrel;

locator key means having an outer configuration adpated to mate with a matching recess of a plurality of locating nipples in the tubing string and once so mated halting further movement of the locating device in one direction through the tubing string;

means for mounting said locator key means on said tool mandrel and for permitting radial movement of said locator key means with respect to said tool mandrel;

means for resiliently biasing said locator key means radially outwardly;

actuator means carried on said tool mandrel and movable between a first position engaging said locator key means and confining said locator key means radially inwardly and a second position disengaged from said locator key means and permitting radially outward movement thereof, said actuator means adapted to be movable to said second position upon engagement with a selective activating means in the well tubing string and wherein while said locator key means are confined radially inwardly, said locator key means may pass through any of said locating nipples without engagement therewith and once said locator key means are freed for radially outward movement said locator key means mate with the next locating nipple having a matching recess upon continued movement of the locating device in said one direction.

10. The locating device of claim 9 additionally including:

releasable holding means for releasably holding said actuator means in said first position.

11. A locating device for locating one of a plurality of identical locating nipples in a well tubing string and thereby locating a well tool in the tubing string, the locating device comprising:

a tool mandrel;

locator key means having an outer configuration adpated to mate with a matching recess of a plurality of locating nipples in the tubing string;

means for mounting said locator key means on said tool mandrel and for permitting radial movement of said locator key means with respect to said tool mandrel;

means for resiliently biasing said locator key means radially outwardly;

actuator means carried on said tool mandrel and movable between a first position engaging said locator key means and confining said locator key means radially inwardly and a second position disengaged from said locator key means and permitting radially outward movement thereof, said actuator means adapted to be movable to said second position upon engagement with a selective activating means in the well tubing string; and wherein said tool mandrel has a recess adapted to receive a portion of said actuator means after said actuator means has moved to their second position for permitting said actuator means to collapse radially inward.

12. A locating device for locating one of a plurality of identical locating nipples in a well tubing string and thereby locating a well tool in the tubing string, the locating device comprising:

a tool mandrel;

locator key means having an outer configuration adapted to mate with a matching recess of a plurality of locating nipples in the tubing string;

means for mounting said locator key means on said tool mandrel and for permitting radial movement of said locator key means with respect to said tool mandrel;

means for resiliently biasing said locator key means radially outwardly;

actuator means carried on said tool mandrel and movable between a first position engaging said locator key means and confining said locator key means radially inwardly and a second position disengaged from said locator key means and permitting radially outward movement thereof, said actuator means adapted to be movable to said second position upon engagement with a selective activating means in the well tubing string; and wherein said actuator means includes alignment leg means for mantaining said actuator means properly aligned in their first position so that they engage the selective activating means in the tubing string and by-pass other restrictions in the tubing string.

13. A locating device for locating one of a plurality of identical locating nipples in a well tubing string and thereby locating a well tool in the tubing string, the locating device comprising:

a tool mandrel;

locator key means having an outer configuration adapted to mate with a matching recess of a plurality of locating nipples in the tubing string;

means for mounting said locator key means on said tool mandrel and for permitting radial movement of said locator key means with respect to said tool mandrel;

means for resiliently biasing said locator key means radially outwardly;

actuator means carried on said tool mandrel and movable between a first position engaging said locator key means and confining said locator key means radially inwardly and a second position disengaged from said locator key means and permitting radially outward movement thereof, said actuator means adapted to be movable to said second position upon engagement with a selective activating means in the well tubing string; and resilient urging means for collapsing said actuator means to its second position.

14. A locating device for locating one of a plurality of identical locating nipples in a well tubing string, the locating device comprising:

a tool mandrel;

locator key means having an outer configuration adapted to mate with a matching recess of a plurality of locating nipples in the tubing string;

means for mounting said locator key means on said tool mandrel and for permitting radial movement of said locator key means with respect to said tool mandrel;

means for resiliently biasing said locator key means radially outwardly;

actuator means carried on said tool mandrel and having stop means for engaging selective activating means in the well, engaging portion for engaging and confining said locator key means radially inwardly, alignment maintaining leg means, and an inwardly facing recess; said actuator means being movable between a first position wherein the engaging portion engages said locator key means and prevents outward radial movement thereof and wherein stop means is expanded to engage an activating means in the well and a second position wherein the engaging portion disengages said locator key means and permits outward radial movement thereof and wherein said stop means is collapsed to pass through the activating means, said leg means coacting with said locator key means to maintain said actuator means aligned as said locating device moves through the tubing string, and wherein said recess means permits said actuator means to collapse radially to move to its second position; and resilient urging means for collapsing said actuator means radially inwardly into said second position.

15. The locating device of claim 14 additionally including releasable holding means for releasably holding said actuator means in their first position.

16. A system for locating a tool train in a well tubing string as the tool train moves through the tubing string, the system comprising:

at least two series of selective locating nipples positioned in the tubing string, each locating nipple of any one series having an internal recess of selected configuration which is different from that of the other locating nipples in its series, and each series of selective locating nipples being spaced vertically with respect to each other in the tubing string;

selective activating means positioned in the tubing string between the different series of selective locating nipples; and a locating tool comprising:

a tool mandrel, locator key means mounted on said tool mandrel, adapted for radially outward movement with respect to said tool mandrel, and having an outer configuration for mating with the recess of one selective locating nipple in each series of selective locating nipples, actuator means for engaging one of said selective actuating means, said actuator means preventing outward radial movement of said locator key means prior to its engagement with said one of said selective activating means, whereby said selector key means bypasses all of said selective locating nipples in each series of locating nipples above said one selective activating means without engagement therewith and mates with the internal recess of the one selected locating nipple in the first series of selective locating nipples below said one selective activating means.

17. As a subcombination in a system for locating a tool train within a tubing string, the subcombination comprising:

at least two series of selective locating nipples positioned in the tubing string, each of said selective locating nipples of any one series of selective locating nipples having an internal recess of selected configuration which selected configuration is different from the internal recess configuration of the other locating nipples in that series of selective locating nipples, and each series of selective locating nipples being spaced vertically from each other in the tubing string; and selective activating means positioned in the tubing string between the different series of selective locating nipples.

* * * * *